US006955381B2

(12) United States Patent
Parker et al.

(10) Patent No.: US 6,955,381 B2
(45) Date of Patent: Oct. 18, 2005

(54) LATCH MECHANISM FOR CASE AND A CARRYING CASE WITH THE LATCH

(75) Inventors: David H. Parker, Torrance, CA (US); Deanna L. Griffith, Topanga, CA (US)

(73) Assignee: Pelican Products, Inc., Torrance, CA (US)

( * ) Notice: Subject to any disclaimer, the term of this patent is extended or adjusted under 35 U.S.C. 154(b) by 95 days.

(21) Appl. No.: 10/610,727

(22) Filed: Jul. 1, 2003

(65) Prior Publication Data

US 2005/0001435 A1 Jan. 6, 2005

(51) Int. Cl.[7] ..... E05C 19/12
(52) U.S. Cl. ..... 292/113; 292/116; 292/247
(58) Field of Search ..... 292/116, 95, 109, 292/110, 117, 118, 113, 247, 256.69, DIG. 49; 220/4.22–4.24

(56) References Cited

U.S. PATENT DOCUMENTS

| | | | | | |
|---|---|---|---|---|---|
| 899,084 | A | * | 9/1908 | Thoits et al. | 292/247 |
| 1,553,712 | A | * | 9/1925 | Myers | 292/340 |
| 2,739,003 | A | * | 3/1956 | Clarke | 292/247 |
| 2,750,064 | A | * | 6/1956 | Clarke | 220/4.24 |
| 2,811,768 | A | * | 11/1957 | Axelson | 27/7 |
| 3,008,745 | A | * | 11/1961 | Tomkinson et al. | 292/113 |
| 3,121,318 | A | | 2/1964 | Norrenberg-Sudhaus | |
| 3,394,955 | A | * | 7/1968 | Martin | 292/113 |
| 4,181,333 | A | * | 1/1980 | Stelma | 292/66 |
| 4,316,626 | A | | 2/1982 | Kafka et al. | |
| 4,326,739 | A | * | 4/1982 | Schlueter | 292/247 |
| 4,743,052 | A | * | 5/1988 | Stammreich et al. | 292/113 |
| 4,761,974 | A | | 8/1988 | Lii | |
| 4,858,970 | A | * | 8/1989 | Tedesco et al. | 292/113 |
| 4,915,913 | A | * | 4/1990 | Williams et al. | 422/119 |
| 4,920,771 | A | | 5/1990 | Jiang | |
| 5,033,778 | A | * | 7/1991 | Niles et al. | 292/66 |
| D324,165 | S | | 2/1992 | Bressler et al. | |
| 5,271,649 | A | * | 12/1993 | Gromotka | 292/113 |
| 5,383,258 | A | * | 1/1995 | Nicoletti | 24/68 SK |
| 5,385,257 | A | * | 1/1995 | Hung | 220/324 |

(Continued)

*Primary Examiner*—Daniel P. Stodola
*Assistant Examiner*—Carlos Lugo
(74) *Attorney, Agent, or Firm*—Charles Berman; Greenberg Traurig, LLP

(57) ABSTRACT

A double throw latch for a carrying case has a first elongated body, a first end of the body being pivotally mounted with one part of a carrying case. There is also a second elongated body that is pivotally mounted on the first elongated body. There is a first hook element on the first elongated body, and the first hook element is located towards a second end of the first elongated body. The first hook element is for engagement with a mating first formation on a second part of the carrying case. There is also an engaging element for engagement with a portion on the first elongated body. The area adjacent to where the second elongated body pivots with the first elongated body provides an inter-engaging surface or element for engagement with an opposite face on the first part of the case. After the second elongated body is toggled a predetermined amount from the closed position, the second elongated body engages the formation of the first elongated body. The first elongated body then separates from the mating first formation of the second part of the carrying case. It thereby disengages the first hook element from the mating first formation on the second part of the case. The first elongated body pivots relative to the first part of the carrying case at a position relatively close to the body of the carrying case.

22 Claims, 3 Drawing Sheets

U.S. PATENT DOCUMENTS 5,626,373 A * 5/1997 Chambers et al. ..... 292/113
5,735,428 A * 4/1998 Chern ..... 220/324
D414,673 S 10/1999 Dickenson et al.
D424,406 S 5/2000 Frey
6,179,350 B1 * 1/2001 Ely et al. ..... 292/113
6,354,461 B1 3/2002 Tenney et al.
D481,293 S 10/2003 Ayrest
D482,593 S 11/2003 Wolf

* cited by examiner

LATCH MECHANISM FOR CASE AND A CARRYING CASE WITH THE LATCH

BACKGROUND OF THE INVENTION

Field of the Invention

This invention relates in general to a latching device. In particular, it is concerned with a latching device for a carrying or protective case, and especially for cases where the two halves of the case need to be tightly secured together.

Many different latches are known for cases. Latches conventionally are single-throw latches wherein an element pivoted on one-half of the case secures with an engaging locking strip element on the second half of the case when the two half portions of the case are is in the closed position. Releasing of the element from the engaging strip permits for unlatching and for the two halves of the case to be opened or separated.

The known latches require a predetermined amount of force to be opened and closed. Depending on the relationship of the latch elements relative to each other, this creates a predetermined amount of closure force between the two halves of the case when closed or brought into engagement by the latching action.

The present invention is directed to provide a suitable latch using double throw action. The latch is suitable for cases that securely carry components. More particularly, the latch provides an appropriate clamping force on the case such that an effective mechanical advantage in leverage is provided. Such leverage force is less than that used in conventional latches.

Cases that would benefit from the latching of the present invention include those which are intended for particularly secure relationship and more specifically those which need to be closed in a watertight relationship. These cases require effective closure and latching in a useful and easy manner while at the same the force provided by the latch should create an effective sealing to the case.

The present invention seeks to overcome the limitations of previously known latches.

SUMMARY OF INVENTION

According to the invention, there is a latch for a carrying case where the latch includes a first elongated body, a first end of the first elongated body being pivotally mounted with one part of a carrying case. There is also a second elongated body that is pivotally mounted on the first elongated body. There is a first hook on the first elongated body, and the first hook is located towards a second end of the first elongated body. The second end is opposite from the first end. The first hook is for engagement with a mating first formation on a second part of the carrying case.

There is also an engaging element or surface on the second elongated body. The engaging element or surface is a formation located towards the second end of the second elongated body. The engaging element is for engagement with a second mating formation on the first elongated body.

In a preferred form of the invention, the back face or back corner interface of the second elongated body levers against the front of the case when the second elongated body is being opened or unlatched. This provides a mechanical advantage about twice the amount of mechanical advantage of a latch having only a single pivoted body.

As a result, the amount of leverage required to open a latch with the first elongated body and the second elongated body is about half the leverage which would be required on the latch using a single pivoted body. With this arrangement, the clamping forces provided by both the first elongated body of the latch and that of the second elongated body latch is substantially the same. The advantage of requiring less leverage to effect opening or unlatching is a significant improvement.

The latch of the present invention acts as a double throw latch in the sense that the second elongated body first moves out of its locked position. The area adjacent to where the second elongated body pivots with the first elongated body provides an inter-engaging surface or element for engagement with an opposite face on the first part of the case. This facilitates leverage for moving the second elongated body about its pivot.

After the second elongated body is toggled or pivoted a predetermined amount from the closed position, the second elongated body engages the mating second formation of the first elongated body. The first elongated body then disengages the first hook from the mating first formation on the second part of the case.

In the preferred form of the invention, the first elongated body pivots relative to the first part of the carrying case at a position relatively close to the body of the carrying case.

In a relative sense, the second elongated body pivots at a position further removed from the body of the carrying case. In the preferred relationship, the second pivoted body is pivotally mounted relatively downwardly and upwardly of the location of the pivoted first elongated body.

In a preferred form of the invention, the first elongated body is located within an elongated cutout formed in the first elongated body. The second elongated body is located such as to extend past the second end of the first elongated body. The portion of the second elongated body extending past the end of the first elongated body defines a width equal to a width of the first elongated body such that collectively the first elongated body and the second elongated body form a unit of substantially uniform width.

The invention is further described with reference to the accompanying drawings. Other features and the advantages of the present invention will be apparent from the following detailed description of the preferred embodiment.

DETAILED DESCRIPTION OF THE PREFERRED EMBODIMENT

Figure 1:
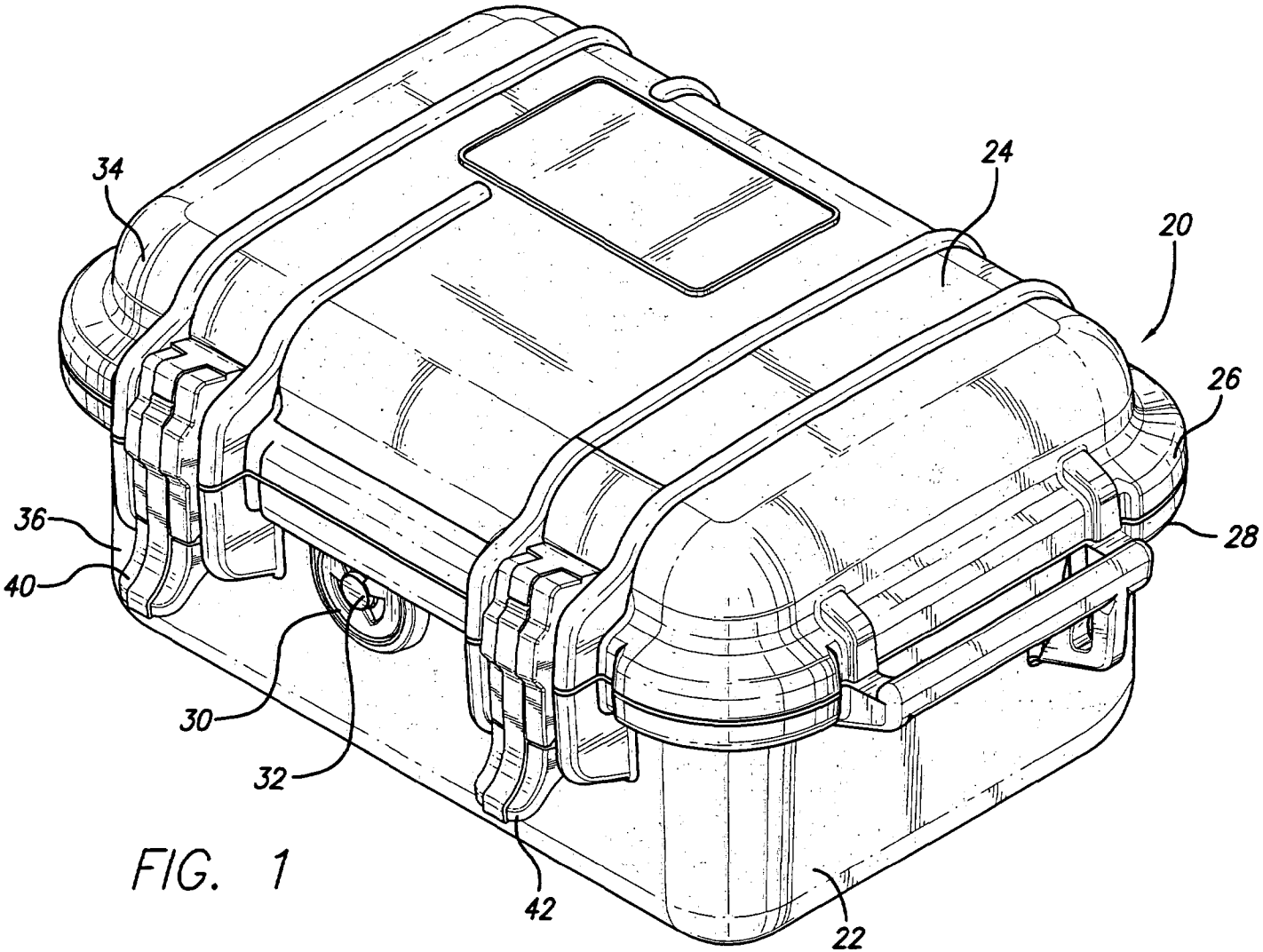
FIG. 1 is a prospective view of one form of a case according to the invention showing two latches in a closed relationship.

In the following description of the preferred embodiment, reference is made to the accompanying drawings which form the part thereof and which are shown by way of illustration of specific embodiments in which the invention may be practiced. It is to be understood that other embodiments may be utilized and structural and functional changes may be made without departing from the scope of the present invention.

A latch for a carrying case comprises a first elongated body, the first elongated body at a first end being pivotally mounted with one part of a carrying case, and a second elongated body, the second elongated body being pivotally mounted on the first elongated body.

A first hook on the first elongated body is located towards a second end of the first elongated body, the second end being opposite from the first end. The first hook is for engagement with a first mating formation on the second part of the carrying case. An engaging portion is located towards the second end of the second elongated body, and the engaging portion is for engagement with a second mating formation on the first elongated body. The first mating formation is mounted on the first part of the carrying case.

The pivot for the second elongated body is located at a position removed from the pivot position of the first body. The second pivot position is located at a position between the first pivot and the first hook.

The second elongated body is located in part within an elongated cut out formed in the first elongated body, and the second elongated body extends past the second end of the first elongated body. Thereafter it extends in width such as to be substantially equal to a width of the first elongated body.

Opening of the latch from a closed position is effected by moving firstly the second elongated body to engage an underside of the first elongated body. This causes the first elongated body to move to release the first hook from the first mating formation on the second part of the case. The movement of the first elongated body is effected by further movement of the second elongated body about its pivot.

The latch can also be for closing and releasing two elements, which may be different to cases.

A carrying case 20 includes two mating components 22 and 24 which forms surrounding material for the case. The top component 24 includes a peripheral lip 26 extending around the periphery for mating engagement with a peripheral lip 28 on the bottom component 22 to ensure relatively closed relationship when the components 22 and 24 are closed. The lips 26 and 28 engage so that if protrusion from lip 26 engages lip 28 in a slot fitted with a suitable gasket between the two lips 26 and 28. The protrusion, slot and gasket creates an effective watertight seal when the elements 22 and 24 are closed and latched with an appropriate sealing force.

The opening and closing of the components 22 and 24 provide access to a space defined by the surrounding material or closure to the space. The two components 22 and 24 are each made of a relatively rigid polycarbonate plastic material. The suitable hinge formation is provided along the backside to permit opening and closing of the case.

A case according to this invention is described in further detail in U.S. patent application Ser. No. 10/001,652 filed Oct. 31, 2001 entitled "Protective Case". The applicant being David H. Parker. The contents of that application are incorporated by reference herein.

A suitable purge valve 30 permits for ingress and egress of pressure to equilibrate the pressure between the inside and the outside of the case. The purge valve 30 is mounted in one wall of the component 22, and inhibits passage of moisture through the valve while permitting passage of air. A purge knob 32 is also provided to cooperate with the valve 30.

On the front face 34 of the top 24 and the front face 36 of the bottom unit 22 there is mounted a formation for securing two latches 40 and 42 respectively. These pair of latches 40 and 42 effectively provide for closing and opening of the two components 22 and 24 about the back cage of the case. Each of the latches 40 and 42 are similar in construction and are described in more detail.

Figure 2:
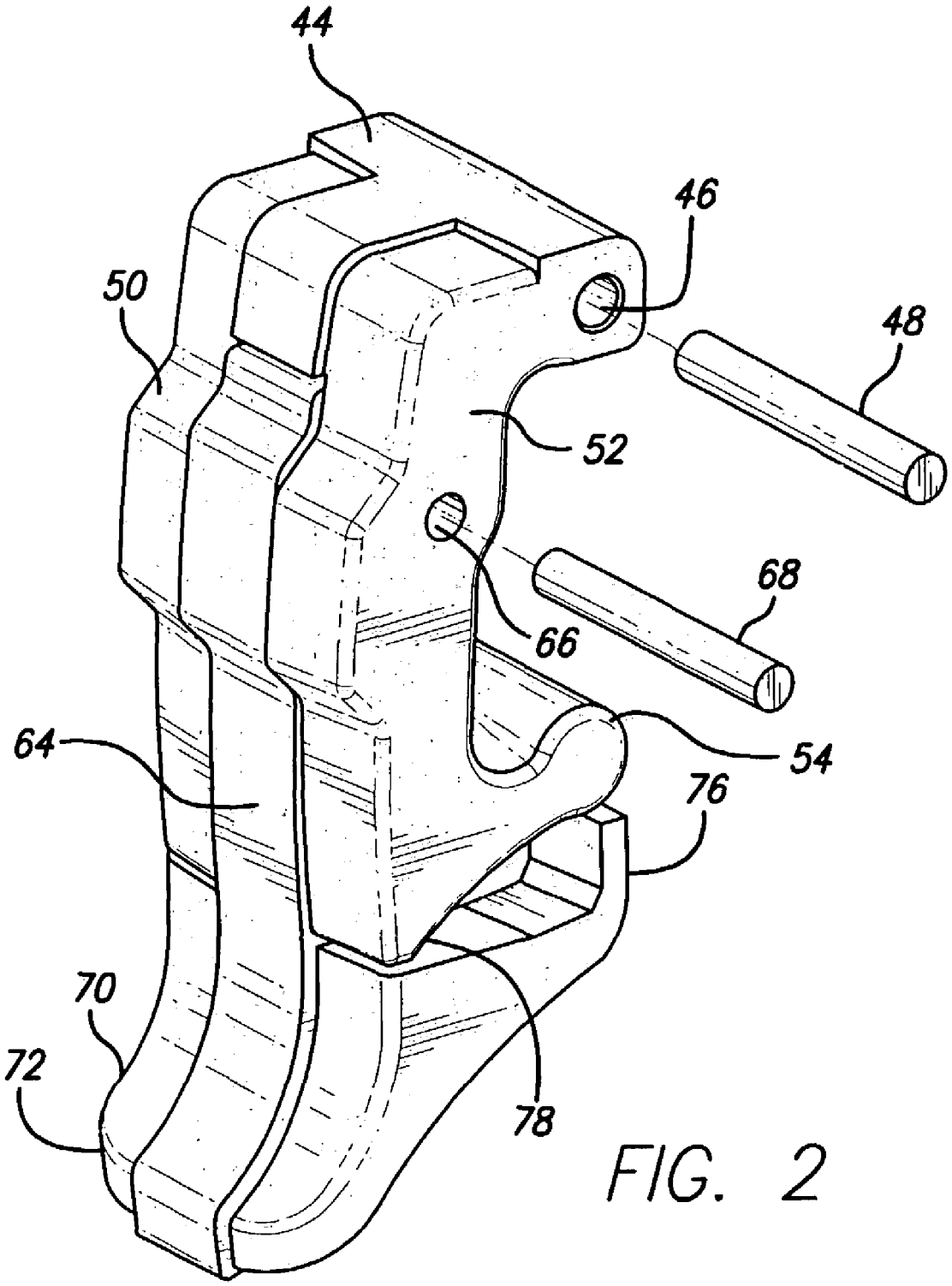
FIG. 2 is an enlarged view of the latch of the invention showing the first elongated body to either side of the second elongated body housed between the two portions of the first elongated body.

As shown in FIG. 2, the latches 40 and 42 include a first elongated body 44. The elongated body 44 has a bore 46 running transversely through a top portion so that a pin 48 can pass through the bore and permit the first elongated body 44 to be pivotally mounted on the front face 34 of the top portion 24 of the case. The first elongated body includes two spaced tines or components 50 and 52 respectively.

A first hook element 54 is provided transversely towards the bottom portion of the first elongated body. The first hook element is for engagement with a mating formation 56 on front face 36 of the bottom portion of the case. This engagement of the formations 54 and 56 acts to keep the components 22 and 24 in closure relationship so that the case can be sealed in relative watertight engagement. In this fashion, the lip 60 extending upwardly from the bottom portion 22 engages with the gasket 62 located in the slot 64 extending around the periphery 24 of the case.

A second elongated body 64 is mounted on the first elongated body in a position forwardly and downwardly relative to the first bore 46 and pin 48. The bore 66 extends through the two arms or tines 50 and 52 of the first elongated body, and extends through an aligned and mating bore in the second elongated body. A pin 68 extends through the bore 66, and the equivalent aligned bore in the second elongated body and in the second arm of the first elongated body.

Figures 3, 4, 5, 6:
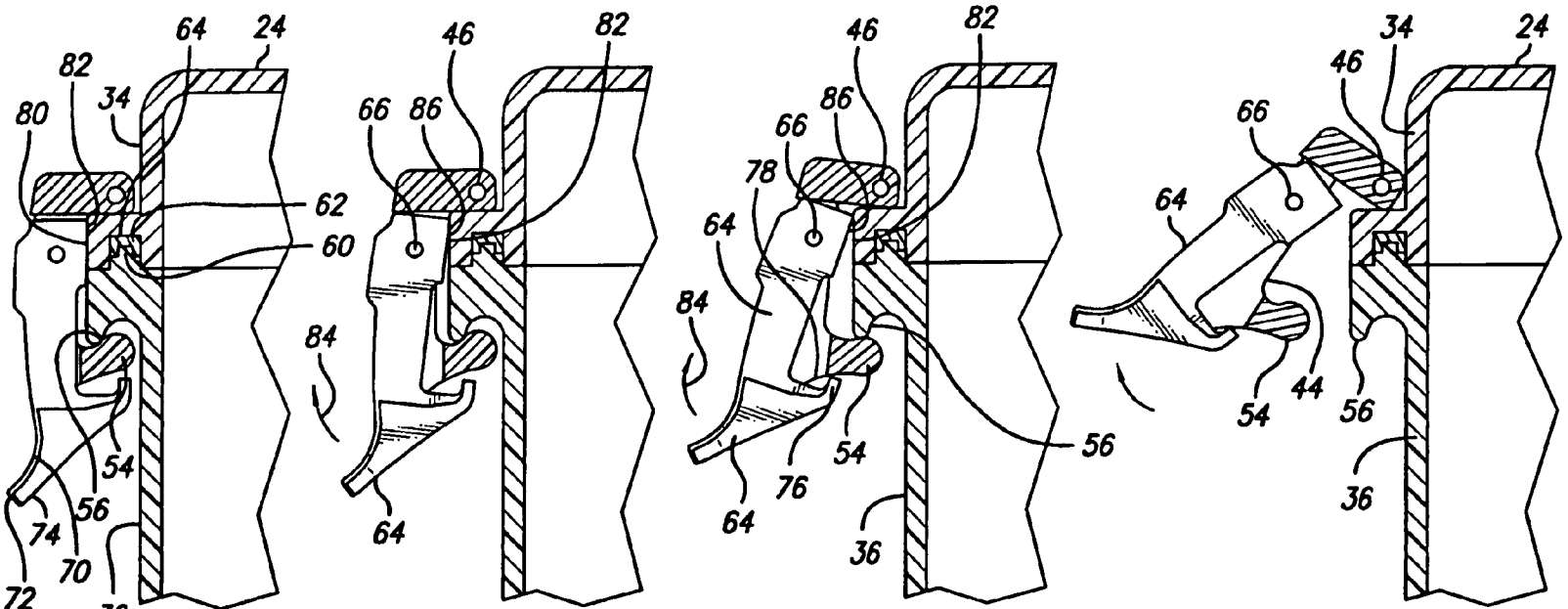
FIG. 3 is a sectional side view showing the first part of the carrying case and a second part of the carrying case with the latch in the closed position.
FIG. 4 is a sectional side view of the case as shown in FIG. 3 and the latch is moved to the first degree of unlatching wherein the second elongated element is moved from its closed position as shown in FIG. 3. The trailing end of the second elongated body adjacent to the pivot engages a protruding portion of the lid of the carrying case.
FIG. 5 is a sectional side view of the case as shown in FIG. 3. The second elongated element of the latch is further removed from the position as shown in FIG. 4 and the first elongated element is partly removed from its seated position as shown in both FIGS. 3 and 4.
FIG. 6 is a sectional side view of the carrying case as shown in FIG. 3. The latch is in the open position wherein the part of the first elongated element is released from the mating formation on the second part of the case. The second elongated element is shown in the engaged position with the first elongated element and the first elongated element is pivoted in a position where the leading end and hook are removed from the case.

The second elongated body 64 can pivot from the position of closure as shown in FIGS. 2 and 3 to an outward position as shown progressively in FIGS. 4, 5 and 6. The extremity 70 of the second elongated body extends in width to about the same extent as the edges of the first and second arms of the first elongated body. As such, a relatively flush side profile is provided to the latch as a unit and the extremity portion 70 provides an outwardly extending wing-like limb 72 which permits for easy gripping by the finger with underneath ridges 74 of the limb 72.

Removed and located inwardly of the extremity portion 70 is a hook 76 which is for engagement with a surface 78 of the first elongated body when the second elongated body is removed to a sufficiently predetermined amount as shown in FIGS. 5 and 6 of the drawings.

As can be seen in FIG. 3, the surface 80 of the second elongated body is flush with the surface 82 of the outside of the protruding top portion 34 of the case 20. This is a latched or locked position of the latch.

As shown in FIG. 4, the second elongated body 64 is moved partially outwardly as indicated by arrow 84. At this point, the surface 80 separates from the surface 82 and there is engagement of the corner 86 with the surface 82. This provides a mechanical advantage to the force applied by the second elongated body in ultimately acting on the first elongated body to move the first body away from its totally locked position as shown in FIG. 3.

As can be seen in FIG. 5 by arrow 84, the second elongated body 64 is in a further removed position and the corner 86 continues to engage the surface 82. This further applies force to the hook 54 to move from its engaged formation 56 on the bottom front 58 of the case. Also in this position, the hook 76 begins to engage the inside surface 78 of the first elongated body and this may provide additional force to pull the hook formation 54 from its engagement formation 56.

As seen in FIG. 6, the second elongated body 64 and the first elongated body 44 are removed such that the hook 54 is no longer in engagement with the hook 56. Both portions of the latch body are pivoted from their locked position. The first elongated body is pivoted outwardly around pivot 46 and the second elongated body is pivoted outwardly around pivot 66.

By this arrangement of the pivots 46 and 66 relative to the portions 34 and 58 of the case, an effective mechanical advantage is achieved of the latch over a single throw latch. Such a single throw latch would be one where there is only a single pivoting action 46 to engage and disengage the hook formation 54 from its mating formation 56.

The downwardly and outwardly spaced relative position of the pivot 66 relative to 46 acts to provide this mechanical advantage. Furthermore, the interaction between the faces 80 and 82 and in particular the corner 86 with the face 82 acts to effectively remove the first elongated body from its hook position with an increased mechanical advantage and better leverage than would otherwise be the case with a single throw latch.

The length of the relative components can change the mechanical advantage appropriately as can the relative positions of the pivots 46 and 66. The net effect of a latch that leads to pivot in the spaced relationship is to provide an advantage which would otherwise not be obtained. The opening and closing of the latch is relatively easier than with a single pivot relationship. At the same time, effective clamping force and sealing force provided between the two components 34 and 58 is essentially the same as with a single throw latch.

Many forms of the invention that exist are different from others in that detail only. For instance, instead of the relationship where the second elongated body has a width along its elongated portions substantially equal to the width of each of the two arms of the first elongated body, the widths can be relatively different. Also, the width at the finger gripping extremity 70 can also be different.

In other forms, instead of the second elongated body being located between two arms of the first elongated body, a form could exist where there are two arms of the second elongated body formed to either side of a single arm of the first elongated body which is between the two arms of the second elongated body. Yet other different side-by-side relationships can be provided for the two elongated body latch formations. In some other forms of the invention there may be more than two elongated bodies and indeed any more than two pivot points spaced in strategic different locations relative to each other to achieve the requisite mechanical advantage and leverage advantage while providing the effective clamping force. Although the reference in this application is to elongated bodies there could be situations where the latch width is relatively equal to or wider than the length.

Although the invention has been described with reference to a protective case, the latch could add equal application to securing any of two components together where appropriate clamping forces are required between the two components and mechanical leverage advantages are required in the leverage necessary to open and close the latch relative to those two components. Thus any two plates, panels, ends of cables, or other bodies can be affixed or fitted with this latching mechanism. In different situations, only a single latch may be used for a protective case or in other situations, more than two latches can be used for the case or to secure different components together.

While the invention is being described with reference to a latch for all cases, it is clear that the latching mechanism of the present invention will have application wherever to two or more plates, elements or surfaces are releasably secured together in an effective relationship and wherein pivotal latch bodies can be used to secure those two elements in a closed or sealed relationship relative to each other.

We claim:

1. A latch for a carrying case comprising:

a. a first elongated body, the first elongated body at a first end being pivotally mounted to one part of the carrying case at a first pivot position;

b. a second elongated body, the second elongated body being pivotally mounted on the first elongated body, wherein the pivot for the second elongated body is located at a position spaced from the pivot position of the first elongated body, the pivot for the second elongated body located at a position between the pivot position of the first elongated body and a first hook;

c. the first hook is on the first elongated body, the first hook being located towards a second end of the first elongated body, the second end being opposite from the first end, and the first hook being for engagement with a first mating formation on a second part of the carrying case; and d. an engaging portion on the second elongated body, the engaging portion being located towards an end of the second elongated body, and the engaging portion being for engagement with a second mating formation on the first elongated body.

2. A latch as claimed in claim 1 wherein the first mating formation mounted on the second part of the carrying case and the second mating formation located on the first elongated body and are spaced from each other and the second mating formation is relatively further from the first part of the carrying case.

3. A latch as claimed in claim 1 wherein the second elongated body is located in part within an elongated cut out formed in the first elongated body.

4. A latch as claimed in claim 1 wherein the second elongated body is located in part within an elongated cut out formed in the first elongated body, and the second elongated body extends past the second end of the first elongated body.

5. A latch as claimed in claim 1 wherein the second elongated body is located in part within an elongated cut out formed in the first elongated body, and the second elongated extends past the second end of the first elongated body, and thereafter extends in width such as to be substantially equal to a width of the first elongated body.

6. A latch as claimed in claim 1 wherein opening of the latch from a closed position is effected by moving firstly the second elongated body to engage an underside of the first elongated body, and causes the first elongated body to move to release the first hook from the first mating formation on the second part of the case, the movement of the first elongated body being effected by further movement of the second elongated body about its pivot.

7. A latch for a carrying case comprising:

a. a first elongated body, the first elongated body at a first end being pivotally mounted with one part of a carrying case;

b. a second elongated body, the second elongated body being pivotally mounted on the first elongated body, wherein the second elongated body is located in part within an elongated cut out formed in the first elongated body, and the second elongated body extends past the second end of the first elongated body, and thereafter extends in width such as to be substantially equal to a width of the first elongated body;

c. a first hook on the first elongated body, the first hook being located towards a second end of the first elongated body, the second end being opposite from the first end, and the first hook being for engagement with a mating first formation on the second part of the carrying case; and d. the movement of the first body being effected by movement of the second body about its pivot, and wherein opening of the latch from a closed position is effected by moving firstly the second elongated body to engage an abutting interface on the first part of the carrying case in a position adjacent to the pivot location of the second elongated body, and subsequently causing the first elongated body to move to release the first hook from the first mating formation on the second part of the varying case, the movement of the first elongated body being effected by further movement of the second body about its pivot.

8. A latch as claimed in claim 7 wherein the first mating formation is mounted on the first part of the carrying case and the second mating formation is located on the first elongated body and is spaced from the first mating formation and is relatively further from the first part of the carrying case, and the engaging portion being located towards the second end of the second elongated body, and the engaging portion being for engagement with a second mating formation on the first elongated body, and wherein opening of the latch from a closed position is effected by moving firstly the second elongated body to engage the first elongated body, and causes the first elongated body to move to release the first hook from the first mating formation on the second part of the case.

9. A latch as claimed in claim 7 wherein the pivot for the second elongated body is located at a position spaced from the pivot position of the first body.

10. A latch as claimed in claim 7 wherein the second elongated body is located in part within an elongated cut out formed in the first elongated body, and the second elongated body extends past the second end of the first elongated body.

11. A latch for closing and releasing two elements comprising:

a. a first body, the first elongated body at a first end being pivotally mounted with a first element;

b. a second body, the second elongated body being pivotally mounted on the first body, wherein the second body is located in part within an cut out formed in the first body, and the second body extends past the second end of the first body, and thereafter extends in width such as to be substantially equal to a width of the first body;

c. a first hook on the first elongated body, the first hook being located towards a second end of the first elongated body, the second end being opposite from the first end, and the first hook being for engagement with a mating first formation on the second element; and d. an engaging portion on the second body, the engaging portion being located towards the second end of the second body, and the engaging portion being for engagement with a formation on the first body.

12. A latch as claimed in claim 11 wherein the pivot for the second body is located at a position spaced from the pivot position of the first body.

13. A latch as claimed in claim 11 wherein the second body is located in part within a cut out formed in the first body, and the second body extends past the second end of the first body.

14. A latch as claimed in claim 11 wherein opening of the latch from a closed position is effected by moving firstly the second body to engage the first elongated body, and causes the first body to move to release the first hook from the first mating formation on the second part of the case, the movement of the first body being effected by further movement of the second body about its pivot.

15. A latch as claimed in claim 11 wherein opening of the latch from a closed position is effected by moving firstly the second body to engage an abutting interface on the element in a position adjacent to the pivot location of the second body, and subsequently cause the first body to move to release the first hook from the first mating formation on the second element, the movement of the first body being effected by further movement of the second body about its pivot.

16. A carrying case comprising:

a first part of the carrying case;

a second part of the carrying case for hingedly closing with the first part;

a first elongated body, the first elongated body at a first end being pivotally mounted with one part of the carrying case at a first pivot position;

a second elongated body, the second elongated body being pivotally mounted on the first elongated body, wherein the pivot for the second elongated body is located at a position spaced from the pivot position of the first body;

a first hook on the first elongated body, the first hook being located towards a second end of the first elongated body, the second end being opposite from the first end, and the first hook being for engagement with a first mating formation on the second part of the carrying case; and an engaging portion on the second elongated body, the engaging portion being located towards the second end of the second elongated body, and the engaging portion being for engagement with a second mating formation on the first elongated body.

17. A carrying case as claimed in claim 16 wherein the first mating formation mounted on the second part of the carrying case and the second mating formation located on the first elongated body are spaced from each other and the second mating formation is relatively further from the first part of the carrying case.

18. A carrying case as claimed in claim 16 wherein the pivot for the second elongated body is located at a position between the first pivot and the first hook.

19. A carrying case as claimed in claim 16 wherein the second elongated body is located in part within an elongated cut out formed in the first elongated body.

20. A carrying case as claimed in claim 16 wherein the second elongated body is located in part within an elongated cut out formed in the first elongated body, and the second elongated body extends past the second end of the first elongated body.

21. A carrying case as claimed in claim 16 wherein the second elongated body is located in part within an elongated cut out formed in the first elongated body, and the second elongated body extends past the second end of the first elongated body, and thereafter extends in width such as to be substantially equal to a width of the first elongated body.

22. A carrying case as claimed in claim 16 wherein opening of the latch from a closed position is effected by moving firstly the second elongated body to engage the first elongated body, and causes the first elongated body to move to release the first hook from the first mating formation on the second part of the case, the movement of the first elongated body being effected by further movement of the second elongated body about its pivot.

* * * * *